US011859856B1

(12) United States Patent
DeLoach et al.

(10) Patent No.: US 11,859,856 B1
(45) Date of Patent: Jan. 2, 2024

(54) HVAC SYSTEM WITH SINGLE PIECE BODY

(71) Applicants: Richard Zane DeLoach, Wentzville, MO (US); David Hull, Seattle, WA (US)

(72) Inventors: Richard Zane DeLoach, Wentzville, MO (US); David Hull, Seattle, WA (US)

(73) Assignee: Renu, Inc., San Francisco, CA (US)

( * ) Notice: Subject to any disclaimer, the term of this patent is extended or adjusted under 35 U.S.C. 154(b) by 438 days.

(21) Appl. No.: 16/733,675

(22) Filed: Jan. 3, 2020

Related U.S. Application Data

(60) Provisional application No. 62/788,342, filed on Jan. 4, 2019, provisional application No. 62/788,314, filed on Jan. 4, 2019, provisional application No. 62/788,350, filed on Jan. 4, 2019, provisional application No. 62/788,334, filed on Jan. 4, 2019.

(51) Int. Cl.
*F24F 13/20* (2006.01)
*F24F 1/032* (2019.01)

(52) U.S. Cl.
CPC ..... *F24F 13/20* (2013.01); *F24F 1/032* (2019.02)

(58) Field of Classification Search
CPC ..... F24F 13/20; F24F 1/032
USPC ..... 62/515
See application file for complete search history.

(56) References Cited

U.S. PATENT DOCUMENTS 2,612,095 A 9/1952 Kennedy
2,658,440 A 11/1953 Lange
3,063,357 A 11/1962 Eberhart
3,623,419 A 11/1971 Taylor
3,703,141 A 11/1972 Pernoud
3,877,356 A 4/1975 Bruns
(Continued)

FOREIGN PATENT DOCUMENTS

CN 104465638 3/2015
CN 108369039 B 7/2020
(Continued)

OTHER PUBLICATIONS

Non-Final Office Action dated Feb. 25, 2020, U.S. Appl. No. 16/250,727, filed Jan. 17, 2019, applicant: Juntao Zhang, 21 pages.
(Continued)

*Primary Examiner* — Steve S Tanenbaum
(74) *Attorney, Agent, or Firm* — Haverstock & Owens, A Law Corporation

(57) ABSTRACT

HVAC system includes a front side access panel, an HVAC unit, a mounting sleeve, and a back side grille. The mounting sleeve and the HVAC unit are configured to fit within the preexisting framing of a building, and in particular to be mounted in a wall, between pre-existing studs, of a room. The HVAC unit can be installed into the mounting sleeve via quick connect mechanisms including, but not limited to, snap in connections and/or tab and slot features. The mounting sleeve enables rapid installation and also condensate collection. The HVAC unit includes an evaporator section, a mechanical section, and a condenser section that are integrally formed as a single physical unit. The design of the HVAC system is optimized to maximize space utilization and support efficient installation and servicing while minimizing product intrusion into living space.

21 Claims, 9 Drawing Sheets

(56) References Cited

U.S. PATENT DOCUMENTS

| | | | | |
|---|---|---|---|---|
| 3,908,750 | A | 9/1975 | Siegel | |
| 5,115,616 | A * | 5/1992 | Nixon | E04F 13/0867 52/800.1 |
| 5,255,532 | A * | 10/1993 | Chae | F24F 13/20 62/325 |
| 5,301,744 | A * | 4/1994 | Derks | F24F 13/20 165/59 |
| 5,396,779 | A | 3/1995 | Voss | |
| 6,371,637 | B1 | 4/2002 | Atchinson | |
| 6,574,975 | B2 | 6/2003 | Bourne et al. | |
| 6,701,741 | B2 * | 3/2004 | Liu | F24F 1/027 62/429 |
| 9,011,216 | B1 | 4/2015 | Al-Alusi | |
| 9,086,226 | B2 | 7/2015 | Bauer | |
| 9,429,923 | B2 | 8/2016 | Ward | |
| 9,519,874 | B2 | 12/2016 | Macek | |
| 9,772,116 | B2 | 9/2017 | Hester | |
| 9,869,484 | B2 | 1/2018 | Hester et al. | |
| 9,933,177 | B2 | 4/2018 | Hester et al. | |
| 10,094,586 | B2 | 10/2018 | Pavlovski | |
| 10,136,549 | B2 | 11/2018 | Steiner | |
| 10,571,414 | B2 | 2/2020 | Turner | |
| 10,708,077 | B2 | 7/2020 | Cui | |
| 11,098,921 | B2 | 8/2021 | Ellis | |
| 11,143,423 | B2 | 10/2021 | Li | |
| 11,156,572 | B2 | 10/2021 | Buda | |
| 2004/0007981 | A1 | 1/2004 | Shibata | |
| 2006/0099904 | A1 | 5/2006 | Belt | |
| 2007/0138307 | A1 | 6/2007 | Khoo | |
| 2010/0141153 | A1 | 6/2010 | Recker | |
| 2010/0262298 | A1 | 10/2010 | Johnson | |
| 2011/0227489 | A1 | 9/2011 | Huynh | |
| 2012/0162965 | A1 | 6/2012 | Takeuchi | |
| 2012/0259469 | A1 | 10/2012 | Ward | |
| 2012/0299489 | A1 | 11/2012 | Sakuragi | |
| 2013/0173064 | A1 | 7/2013 | Fadell | |
| 2014/0087158 | A1 * | 3/2014 | Ciuperca | B32B 3/266 428/223 |
| 2014/0175996 | A1 | 6/2014 | Yoon | |
| 2014/0249876 | A1 | 9/2014 | Wu | |
| 2014/0260034 | A1 * | 9/2014 | Ciuperca | E04C 5/125 52/405.3 |
| 2015/0043212 | A1 | 2/2015 | Coffey | |
| 2015/0204600 | A1 * | 7/2015 | Fay | F24F 13/20 62/129 |
| 2016/0123619 | A1 | 5/2016 | Hester | |
| 2016/0201933 | A1 | 7/2016 | Hester | |
| 2016/0201934 | A1 | 7/2016 | Hester | |
| 2016/0223214 | A1 | 8/2016 | Turner | |
| 2016/0223216 | A1 | 8/2016 | Buda | |
| 2016/0305678 | A1 | 10/2016 | Pavlovski | |
| 2016/0034137 | A1 | 11/2016 | Dekker | |
| 2017/0003039 | A1 | 1/2017 | Lazzari | |
| 2017/0074534 | A1 | 3/2017 | Turner | |
| 2017/0138542 | A1 | 5/2017 | Gielen | |
| 2017/0146261 | A1 | 5/2017 | Rogers et al. | |
| 2018/0004172 | A1 | 1/2018 | Patel | |
| 2018/0202678 | A1 | 7/2018 | Ahuja | |
| 2018/0206414 | A1 * | 7/2018 | Goodman | A01G 9/022 |
| 2018/0335220 | A1 * | 11/2018 | Matambo | F24F 11/74 |
| 2018/0363893 | A1 | 12/2018 | Cheng | |
| 2019/0078801 | A1 | 3/2019 | Turney et al. | |
| 2019/0103182 | A1 | 4/2019 | Borshch | |
| 2019/0120438 | A1 | 4/2019 | Wan | |
| 2019/0158305 | A1 | 5/2019 | Cui | |
| 2019/0166661 | A1 | 5/2019 | Gao | |
| 2019/0309975 | A1 | 10/2019 | Salem | |
| 2019/0338974 | A1 | 11/2019 | Turney | |
| 2019/0338975 | A1 | 11/2019 | Ray | |
| 2019/0353378 | A1 | 11/2019 | Ramamurti | |
| 2019/0353384 | A1 | 11/2019 | Laughman | |
| 2019/0360711 | A1 | 11/2019 | Sohn | |
| 2020/0088427 | A1 | 3/2020 | Li | |
| 2020/0256581 | A1 | 8/2020 | Wang | |
| 2020/0355391 | A1 | 11/2020 | Wenzel | |
| 2021/0011443 | A1 | 1/2021 | McNamara | |
| 2021/0018205 | A1 | 1/2021 | Ellis | |
| 2021/0018211 | A1 | 1/2021 | Ellis | |
| 2021/0025617 | A1 | 1/2021 | Hamada | |
| 2021/0055011 | A1 | 2/2021 | Smith | |
| 2021/0102722 | A1 | 4/2021 | Nabi | |
| 2021/0140660 | A1 | 5/2021 | Kogo | |
| 2021/0140671 | A1 | 5/2021 | Francis | |
| 2021/0173366 | A1 | 6/2021 | Turney | |
| 2021/0191348 | A1 | 6/2021 | Lee | |
| 2021/0270487 | A1 | 9/2021 | Salem | |
| 2021/0285671 | A1 | 9/2021 | Du | |
| 2021/0325072 | A1 | 10/2021 | Lin | |
| 2021/0364181 | A1 | 11/2021 | Risbeck | |

FOREIGN PATENT DOCUMENTS

| | | | |
|---|---|---|---|
| JP | 3608500 | B2 | 1/2005 |
| JP | 3686195 | B2 | 8/2005 |
| JP | 2008215807 | A | 9/2008 |
| JP | 2015094558 | A | 5/2015 |
| JP | 2019113214 | A | 7/2019 |

OTHER PUBLICATIONS

Notice of Allowance dated Jun. 11, 2019, U.S. Appl. No. 16/197,003, filed Jan. 20, 2018, Applicant: Shanfu Gao, 5 pages.

Liu, Weiwei, Zhiwei Lian and Bo Zhao. "A neural network evaluation model for individual thermal comfort." Energy and Buildings 39.10 (2007): 1115-1122. (Year: 2007).

* cited by examiner

HVAC SYSTEM WITH SINGLE PIECE BODY

RELATED APPLICATIONS

This Patent Application claims priority under 35 U.S.C. 119(e) of the U.S. provisional patent application, Application Ser. No. 62/788,314, filed on Jan. 4, 2019, and entitled "HVAC Control System", U.S. provisional patent application, Application Ser. No. 62/788,334, filed on Jan. 4, 2019, and entitled "HVAC System with Modular Architecture", U.S. provisional patent application, Application Ser. No. 62/788,342, filed on Jan. 4, 2019, and entitled "HVAC System with Single Piece Body", U.S. provisional patent application, Application Ser. No. 62/788,350, filed on Jan. 4, 2019, and entitled "HVAC System with Coil Arrangement in Blower Unit", which are each hereby incorporated in their entireties by reference.

FIELD OF THE INVENTION

The present invention is generally directed to a HVAC (Heating, Ventilating, and Air Conditioning) system. More specifically, the present invention is directed to an HVAC system with a single piece body.

BACKGROUND OF THE INVENTION

An air conditioning system typically includes an evaporator coil, a condenser, an accumulator, a condenser, and a metering device. The components are interconnected by pipes or tubing, and separate fans move air across the evaporator coil and the condenser. A refrigerant is in various phases as it flows through the air conditioning components. Circulating refrigerant vapor enters the compressor and is compressed to a higher pressure, resulting in a higher temperature as well. The compressed refrigerant vapor is now at a temperature and pressure at which it can be condensed and is routed through the condenser. In the condenser, the compressed refrigerant vapor flows through condenser coils. A condenser fan blows air across the condenser coils thereby transferring heat from the compressed refrigerant vapor to the flowing air. Cooling the compressed refrigerant vapor condenses the vapor into a liquid. The condensed refrigerant liquid is output from the condenser to the accumulator where the condensed refrigerant liquid is pressurized. The condensed and pressurized refrigerant liquid is output from the accumulator and routed through the metering device where it undergoes an abrupt reduction in pressure. That pressure reduction results in flash evaporation of a part of the liquid refrigerant, lowering its temperature. The cold refrigerant liquid/vapor is then routed through the evaporator coil. The result is a mixture of liquid and vapor at a lower temperature and pressure. The cold refrigerant liquid-vapor mixture flows through the evaporator coil and is completely vaporized by cooling the surface of the evaporator coil and cooling air moving across the evaporator coil surface. The resulting refrigerant vapor returns to the compressor to complete the cycle.

In a single family unit, certain components of the air conditioning system are located inside the house and other components are located outside, for example the condenser and condenser fan are located outside the house and the remaining components are located inside. Typically, the inside components are co-located with the furnace, related air moving components, and air ducts associated with the house's HVAC system. However, in multi family units, such as apartment or condominium complexes, separate positioning of the air conditioning components both inside and outside of each unit is not always feasible. Integrated, box-like, air conditioning units are often used. Such units can be mounted in windows or custom sized wall openings, with a portion of the unit extending into the living area and another portion extending outside beyond an outer wall of the dwelling.

SUMMARY OF THE INVENTION

Embodiments are directed to an HVAC system that includes a front side access panel, an HVAC unit, a mounting sleeve, and a back side grille. The mounting sleeve and the HVAC unit are configured to fit within the preexisting framing of a building, and in particular to be mounted in a wall, between pre-existing studs, of a room. The HVAC unit can be installed into the mounting sleeve via quick connect mechanisms including, but not limited to, snap in connections and/or tab and slot features. The mounting sleeve enables rapid installation and also condensate collection. The HVAC unit includes an evaporator section, a mechanical section, and a condenser section that are integrally formed as a single physical unit. The design of the HVAC system is optimized to maximize space utilization and support efficient installation and servicing while minimizing product intrusion into living space. The HVAC system includes vertically oriented HVAC components and component connections that are self-aligned. In some embodiments, the HVAC system can be further configured with a horizontal configuration portion for multi-zone capability.

In an aspect, a heating, ventilation, and air condition (HVAC) system is disclosed. The HVAC system includes an HVAC unit and a mounting sleeve. The HVAC unit comprises an evaporator section having a first heat exchanger, a mechanical section having an HVAC unit controller, and a condenser section having a second heat exchanger. The evaporator section, the mechanical section, and the condenser section are integrated as a single unit. The mounting sleeve configured to fit within a preexisting framework of a dwelling. In some embodiments, the HVAC system further comprises a front side access panel coupled to a front side of the HVAC unit. In some embodiments, the front side access panel comprises a front side grille aligned with the evaporator section. In some embodiments, the HVAC system further comprises a back side grille coupled to a back side of the HVAC unit. In some embodiments, the mounting sleeve includes a back side opening in a back side wall, the back side opening is aligned with the condenser section of the HVAC unit and an exterior opening of the dwelling, further wherein the back side grille is positioned over back side opening. In some embodiments, the mounting sleeve comprises a back side wall, side walls, a top wall and a bottom wall, wherein the back side wall is mounted to a framing back side wall of the preexisting framework, and each of the side walls is mounted to a stud of the preexisting framework. In some embodiments, one or more of the side walls of the mounting sleeve includes an electrical outlet opening. In some embodiments, the mechanical section further comprises an electrical power cord, a first end of which is configured to fit through the electrical outlet opening. In some embodiments, the mounting sleeve comprises a bottom side wall that is sloped downward from a front side of the HVAC unit to a back side of the HVAC unit. In some embodiments, the bottom side wall comprises one or more drainage openings. In some embodiments, the mounting sleeve further comprises a back side wall having one or more drainage openings proximate the bottom side wall. In some embodiments, the HVAC unit further comprises interconnecting refrigerant tubing coupled to the evaporator section, the mechanical section, and the condenser section. In some embodiments, the HVAC unit further comprises first mounting features and the mounting sleeve further comprises second mounting features for mounting to the first mounting features. In some embodiments, the first heat exchanger of the evaporator section comprises an evaporator coil, and the evaporator section further comprises an air mover configured to move air across the evaporator coil. In some embodiments, the second heat exchanger of the condenser section comprises a condenser coil, and the condenser section further comprises an air mover configured to move air across the condenser coil. In some embodiments, the condenser section further comprises an accumulator coupled to the condenser coil. In some embodiments, the mechanical section further comprises a compressor and a metering device.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Embodiments of the present application are directed to an HVAC system. Those of ordinary skill in the art will realize that the following detailed description of the HVAC system is illustrative only and is not intended to be in any way limiting. Other embodiments of the HVAC system will readily suggest themselves to such skilled persons having the benefit of this disclosure.

Reference will now be made in detail to implementations of the HVAC system as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
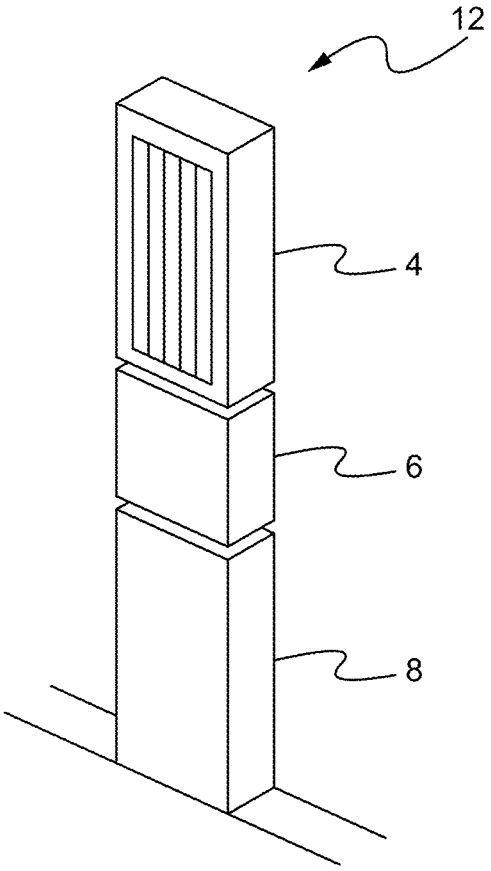
FIG. 1 illustrates a perspective view of the HVAC unit as assembled according to some embodiments.

FIG. 1 illustrates a perspective view of the HVAC unit 12 as assembled according to some embodiments. In some embodiments, the HVAC unit 12 is installed within the preexisting framing of a wall, although as shown in FIG. 1 this framing is removed to better illustrate the HVAC unit as assembled. The HVAC unit 12 includes three sub-assemblies: an indoor air cycling section 4, a mechanical section 6, and an outdoor air cycling section 8. The indoor air cycling section, or simply "indoor section", cycles air from an interior area of a dwelling (indoors) and back out to the interior area. The outdoor air cycling section, or simply "outdoor section", cycles air from an area exterior to the dwelling (outdoors) and back out to the exterior area. In an application where air conditioning cooling is performed, the indoor section functions as an evaporator section, and the outdoor section functions as a condenser section. Subsequent discussion is directed to air conditioning cooling and therefore reference is made to an evaporator section and a condenser section. It is understood that the HVAC unit also can be used for heating, in which case the functionality of the indoor section and the outdoor section can be reversed from that described regarding an evaporator section and a condenser section. Although subsequent description is directed to an evaporator section and a condenser section, it is understood that such description can be generally applied to an indoor section and an outdoor section that performs a heating function. The evaporator section 4 includes a heat exchanger, an air mover, and electrical circuitry. In some embodiments, the heat exchanger includes an evaporator coil and interconnecting refrigerant tubing. In some embodiments, the air mover includes a motor and a fan. In some embodiments, the electrical circuitry includes power wiring, control wiring, and control/diagnostic sensors. The mechanical section 6 includes refrigerant loop components, in-line components, and electrical circuitry. In some embodiments, the refrigerant loop components include a compressor and a metering device, such as an electronic expansion valve. In some embodiments, the in-line components include one or more valves, one or more filters, and interconnecting refrigerant tubing. In some embodiments, the electrical circuitry of the mechanical section includes HVAC unit controls, electrical components, power wiring, control wiring, and control/diagnostics sensors. The condenser section 8 includes a heat exchanger, an air mover, an auxiliary heating component, air quality components, and electrical circuitry. In some embodiments, the heat exchanger of the condenser section includes a condenser coil and interconnecting refrigerant tubing. The condenser section can also include an accumulator. In some embodiments, the air mover in the condenser section includes a motor and a fan. In some embodiments, the auxiliary heating component includes one or more resistive heating elements. In some embodiments, the air quality components include an air filter and ventilation components. In some embodiments, the electrical circuitry of the condenser section includes power wiring, control wiring, and control/diagnostic sensors.

Figure 2:
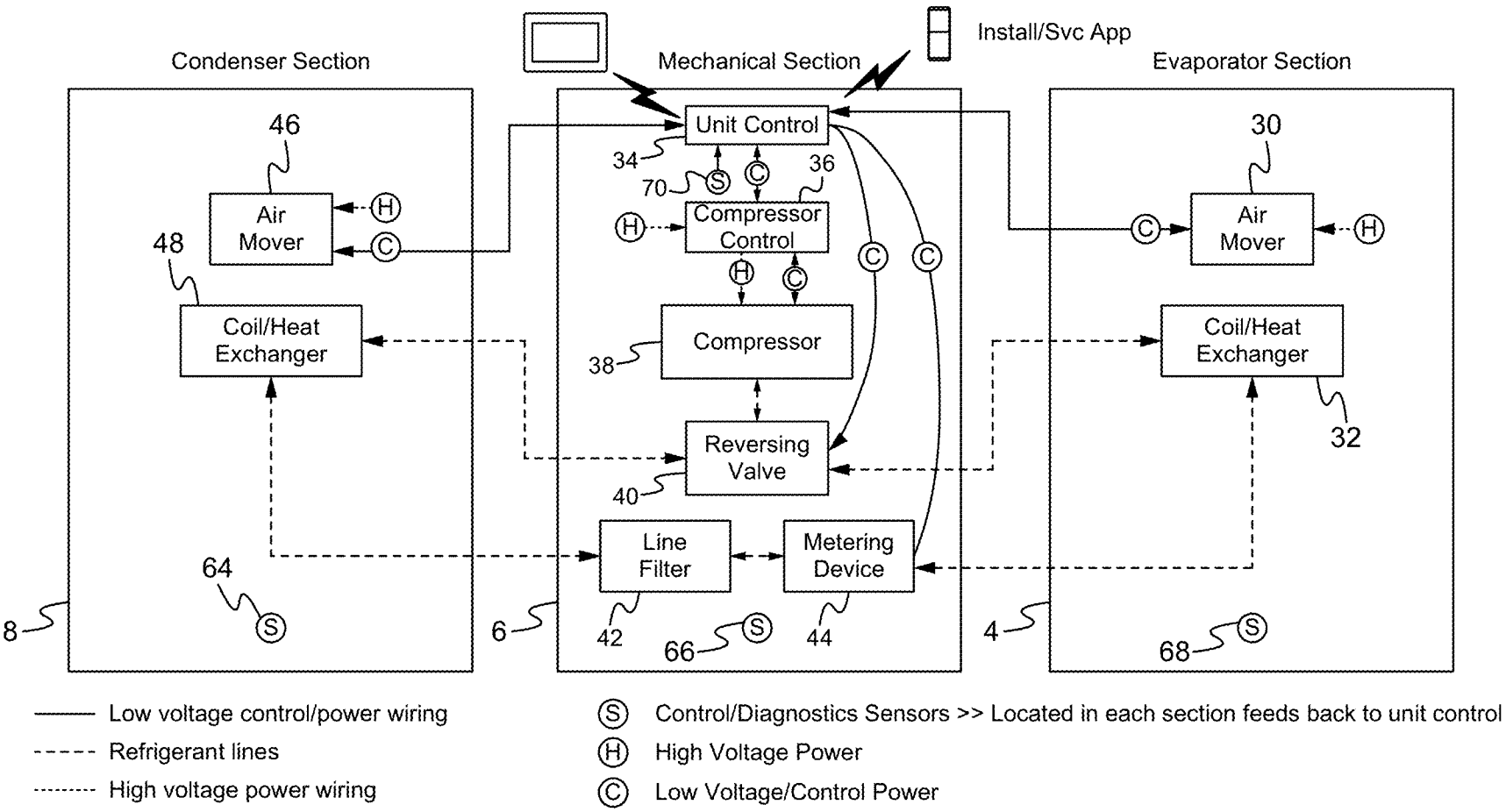
FIG. 2 illustrates a schematic block diagram of the HVAC unit and constituent components corresponding to air conditioning functionality according to some embodiments.

FIG. 2 illustrates a schematic block diagram of the HVAC unit 12 and constituent components corresponding to air conditioning functionality according to some embodiments. A heat exchanger 32 including an evaporator coil in the evaporator section 4 is coupled to a compressor 38 via interconnecting refrigerant tubing and one or more valves 40. The compressor 38 is coupled to a heat exchanger 48 including a condenser coil in the condenser section 8 via interconnecting refrigerant tubing and the one or more valves 40. The heat exchanger 48 can also include an accumulator (not shown) that is coupled to the condenser coil via interconnecting refrigerant tubing. The heat exchanger 48 is coupled to a metering device 44 via interconnecting refrigerant tubing, one or more valves, and filters 42. The metering device 44 is coupled to the heat exchanger 32 via interconnecting refrigerant tubing. In this manner a refrigerant loop is formed, where the refrigerant loop includes the evaporator coil in the heat exchanger 32, the compressor 38, the condenser coil and the accumulator in the heat exchanger 48, the metering device 44, and the interconnecting pipes, valves, and filters. It is understood that the number and configuration of interconnecting refrigerant tubing, valves, and filters shown in FIG. 2 is for exemplary purposes only and that alternative configurations are also contemplated for interconnecting the heat exchanger 32, the compressor 38, the heat exchanger 48, and the metering device 40. It is also understood that the direction of refrigerant flow can be one direction for cooling functionality (air conditioning) and the other direction for heating functionality.

An air mover 30 in the evaporator section 4 is coupled to the heat exchanger 32 to blow air over the evaporator coil, and an air mover 46 in the condenser section 8 is coupled to the heat exchanger 48 to blow air over the condenser coil. A compressor controller 36 is coupled to the compressor 38. An HVAC unit controller 34 is coupled to the air mover 30, the compressor controller 36, the one or more valves such as valves 40, the metering device 44, and the air mover 46. Control signaling, indicated by "C" in FIG. 2, is transmitted between the compressor controller 36 and the compressor 38, and between the HVAC unit controller 34 and the air mover 30, the compressor controller 36, the one or more valves such as valves 40, the metering device 44, and the air mover 46. In some embodiments, the compressor controller 36 can be integrated as part of the HVAC unit controller 34. Control/diagnostic sensors 64, 66, 68, 70 can be used to sense various ambient conditions, such as temperature or humidity, which are connected back to the HVAC unit controller 34 and can be used to control the various components of the HVAC unit 12. High voltage power, such as 120 VAC, is supplied to each of the air mover 30, the compressor controller 36, and the air mover 46. High voltage power can be supplied from the compressor controller 36 to the compressor 38. High voltage power input is indicated by "H" in FIG. 2. Low voltage power is supplied to the unit controller 34. Low voltage power can be provided via wiring labeled "C". It is understood that alternative power supply configurations are also contemplated.

In some embodiments, air filters are included as part of the evaporator section 4 and the condenser section 8. Air is drawn into the evaporator section 4, such as from the room in which the HVAC is installed, directed across the evaporator coil, and output from the evaporator section 4 back into the room. The air filter can be positioned at an air intake portion of the evaporator section 4 such that air is filtered prior to being blown across the evaporator coil. Similarly, air is drawn into the condenser section 8, such as from outside the dwelling within which the HVAC is installed, directed across the condenser coil, and output from the condenser section 8 back outside the dwelling. The air filter can be positioned at an air intake portion of the condenser section 8 such that air is filtered prior to being blown across the condenser coil.

Figure 3:
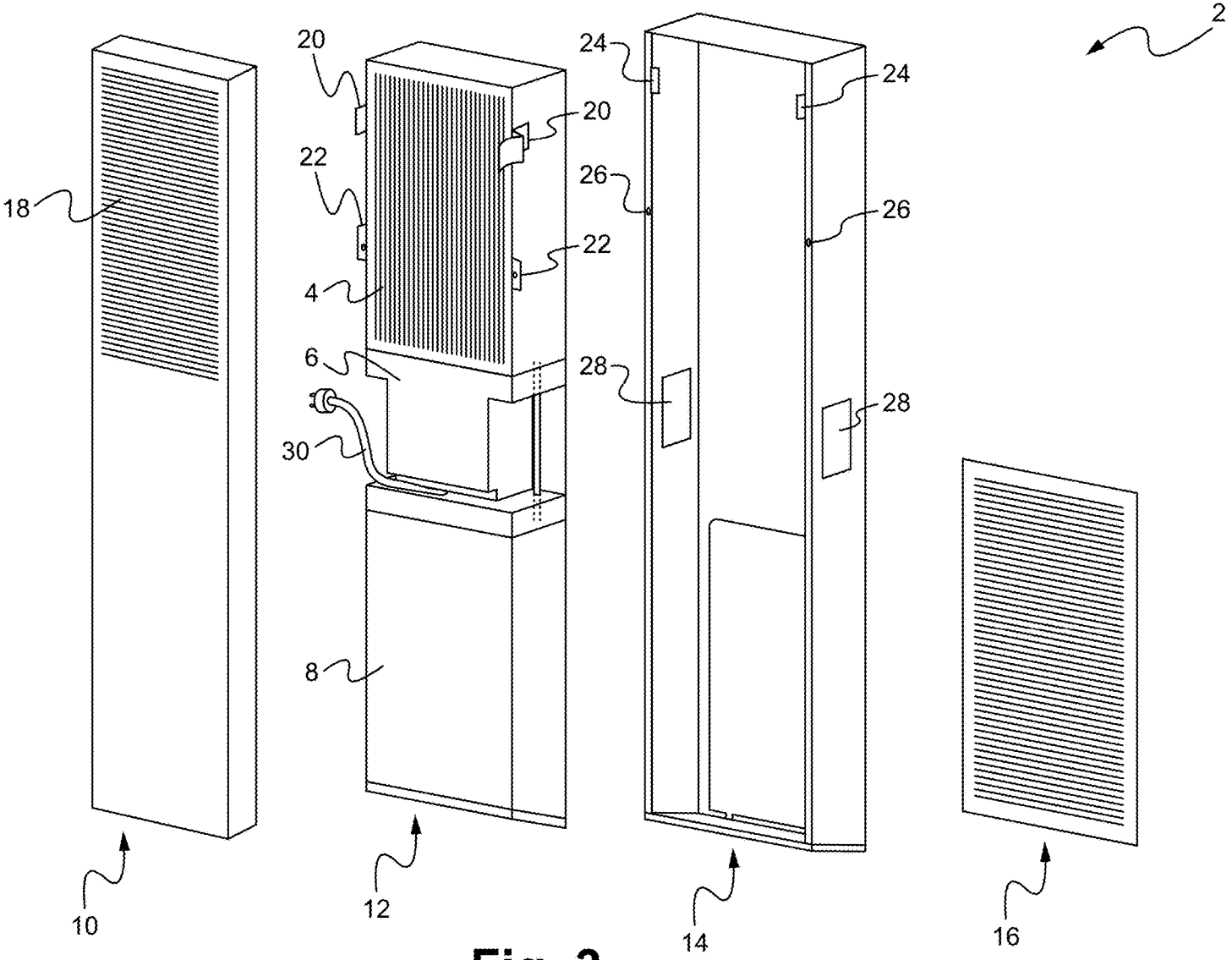
FIG. 3 illustrates an exploded view of an HVAC system having a single piece HVAC unit according to some embodiments.
Figure 4:
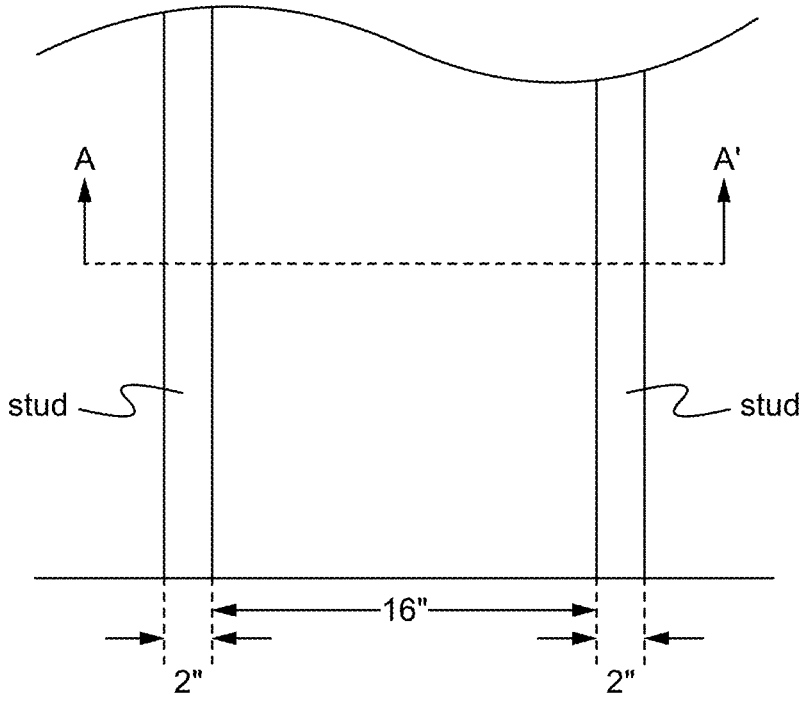
FIG. 4 illustrates an exemplary preexisting framework into which the HVAC system can be installed according to some embodiments.
Figure 5:
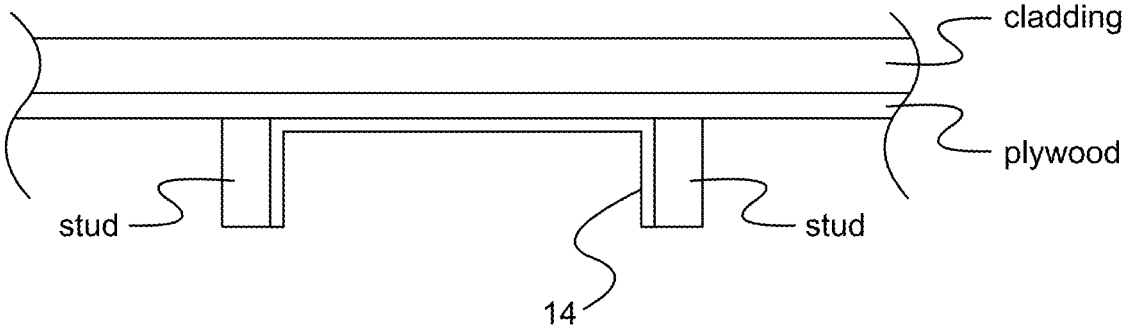
FIG. 5 illustrates a top down view of the mounting sleeve mounted in a preexisting framework of a wall according to some embodiments.

In some embodiments, the HVAC unit is an integrated single unit that includes the evaporator section, the mechanical section, and the condenser section integrated as a single piece body. The single piece HVAC unit is mounted within a mounting sleeve, and an indoor grille and an outdoor grille are attached to cover exposed portions of the HVAC unit. FIG. 3 illustrates an exploded view of an HVAC system having a single piece HVAC unit according to some embodiments. The HVAC system includes a front side access panel 10, a single piece HVAC unit 12, a mounting sleeve 14, and a back side grille 16. The mounting sleeve 14 is configured to be mounted between preexisting framework of a dwelling, such as a room of an apartment or condominium. In an exemplary application, the mounting sleeve fits between two adjoining studs in a wall. FIG. 4 illustrates an exemplary preexisting framework into which the HVAC system can be installed according to some embodiments. The preexisting framework can be an exposed portion of a wall. As shown in FIG. 3, the exposed portion of the wall has the drywall removed from an interior side of the room, thereby exposing adjacent studs and the area in between. The area between the adjacent studs is void of insulating material, electrical wiring, plumbing, and the like so as to enable positioning and mounting of the mounting sleeve 14 within this area. The mounting sleeve 14 is sized to fit conventional framing configurations. For example, a conventional opening between adjacent studs is 16". FIG. 5 illustrates a top down view of the mounting sleeve mounted in a preexisting framework of a wall according to some embodiments. The top down view shown in FIG. 5 corresponds to the cross-section A-A' shown in FIG. 4. A back side of the area between the studs may include plywood, cladding, and/or other materials known in the art. In an exemplary configuration, a back side surface that is exposed within the area between adjacent studs is made of plywood. The mounting sleeve 14 is configured to fit within the area between adjacent studs and against the back side surface. In some embodiments, the mounting sleeve 14 is secured to the adjacent studs using screws. The mounting sleeve 14 can include holes to receive the screws, or the screws can be screwed in directly through the mounting sleeve material, forming holes as the screws are applied. In some embodiments, the mounting sleeve 14 is also secured to the back side surface of the preexisting framework in a manner similar to that of the studs. It is understood that alternative techniques can be used to secure the mounting sleeve to the preexisting framework.

In some embodiments, one or both of the adjacent studs are configured with a power outlet, such as an AC voltage wall socket, or include a hole through which electrical wiring can be strung to access a power outlet. The mounting sleeve 14 can be configured with one or more side openings, such as side openings 28 shown in FIG. 3, coincident with the power outlets on one or both of the adjacent studs. The side openings 28 enable the HVAC unit 12 to access the power outlet(s) and connect to power. In some embodiments, the HVAC 12 includes a power cord and plug 29 configured for connecting to a conventional power outlet, such as the AC voltage wall socket, which provides the high voltage power "H".

The HVAC unit 12 and the mounting sleeve 14 each include complementary mounting apparatuses for mounting the HVAC unit 12 to the mounting sleeve 14. In the exemplary configuration shown in FIG. 3, the mounting sleeve 14 includes holes 26 in the side walls and also includes flanges 24 that extend from the side walls. The HVAC unit 12 includes mounting tabs 20 configured to mate to the flanges 24 in the mounting sleeve 14. The HVAC unit 12 also includes flanges 22 with holes where screws or fasteners, such as quarter turn fasteners, can be inserted into the holes 26 of the mounting sleeve 14. The holes 26 can be screw holes for accepting screws or fasteners. It is understood that additional mounting tab/flange and/or flange/screw hole combinations can be used, or only mounting tab/flange or only flange/screw hole implementations can be used. It is further understood that alternative complementary mounting apparatuses can be used to mount the HVAC unit 12 to the mounting sleeve 14.

Figure 6:
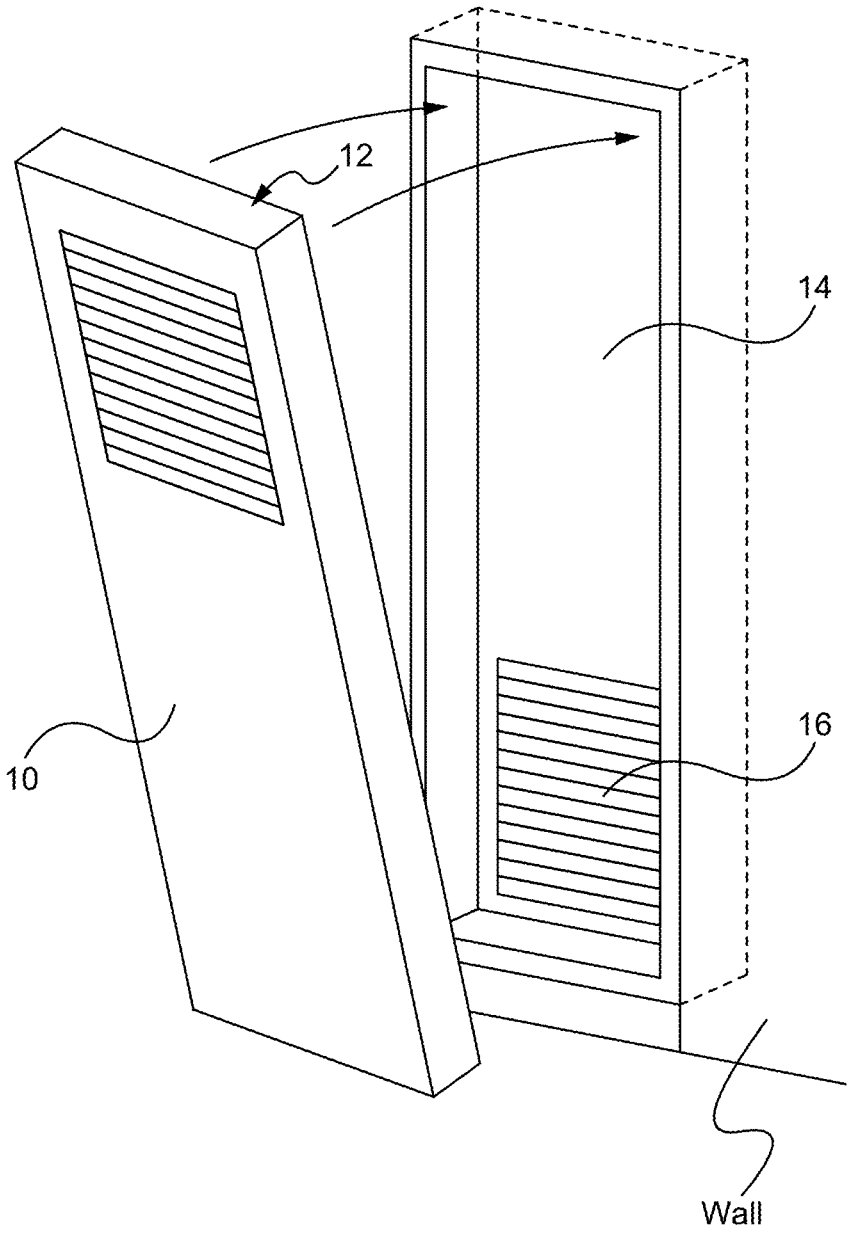
FIG. 6 illustrates a perspective view of the front side access panel and the HVAC unit being mounted into the mounting sleeve according to some embodiments.

In some embodiments, the front side access panel 10 and the HVAC unit 12 can be installed into the mounted mounting sleeve 14 by pivoting from a resting position on the floor. FIG. 6 illustrates a perspective view of the front side access panel 10 and the HVAC unit 12 being mounted into the mounting sleeve 14 according to some embodiments. The front side access panel 10 can be positioned in a horizontal position on the floor and the HVAC unit 12 positioned within the front side access panel 10. A bottom end of the HVAC unit 12 is positioned adjacent to the wall opening into which the mounting sleeve 14 is mounted. The top end of the HVAC unit 12 is then rotated into the mounting sleeve 14, and the mounting tabs 20 attach to the flanges 24 of the mounting sleeve 14. The flanges 22 of the HVAC unit 12 are then attached at the holes 26 of the mounting sleeve 14. In some embodiments, the front side access panel 10 is removed to enable attachment of the flanges 22 to the mounting sleeve 14. In other embodiments, the HVAC unit 12 is rotated into the mounting sleeve 14 without the front side access panel 10, and the front side access panel 10 is attached after the HVAC unit 12 has been mounted and secured to the mounting sleeve 14. The back side grille 16 is attached on an exterior surface of the dwelling and can be attached either before or after the HVAC unit 12 is mounting in the mounting sleeve 14.

Figure 7:
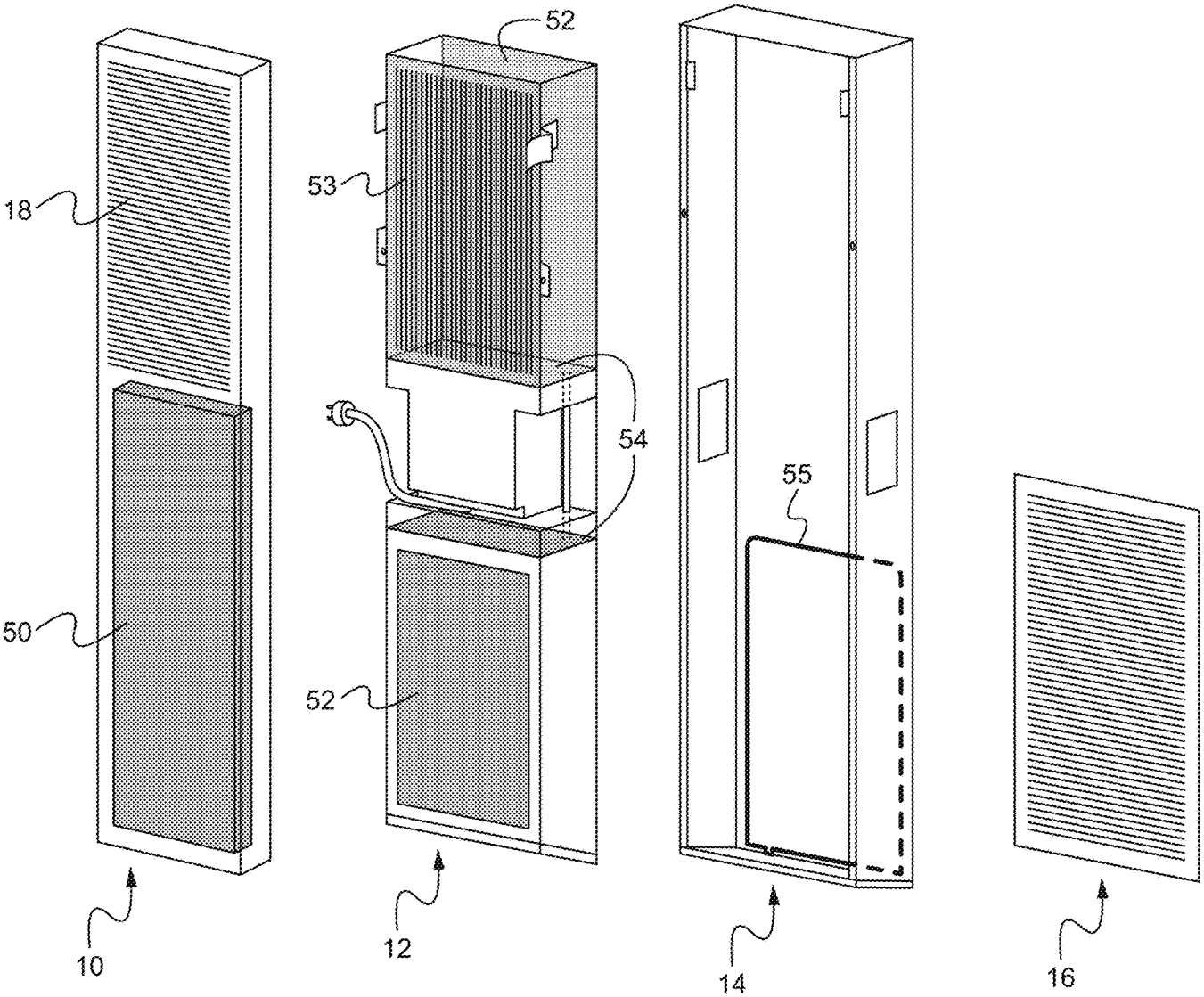
FIG. 7 illustrates an exploded view of the HVAC system including exemplary materials for providing thermal, sound, and water isolation according to some embodiments.

Various materials can be added to provide thermal, sound, and water isolation. In particular, thermal and sound resistant materials can be included to provide thermal and sound isolation of the HVAC unit from the interior dwelling. Water resistant materials can be used to manage condensate formed in the evaporator section. FIG. 7 illustrates an exploded view of the HVAC system including exemplary materials for providing thermal, sound, and water isolation according to some embodiments. A sound isolation panel 50 can be positioned on an interior surface of the front side access panel 10 without blocking the grille 18. Similar material can be positioned around or proximate the air mover 30 in the evaporator section 4 and the air mover 46 in the condenser section 8 to provide vibrational isolation. Thermal isolation panels 52 can be positioned on the back side facing surface of the evaporator section 4 and the front side facing surface of the condenser section 8. A thermal isolation trim 53 can be positioned around a front side facing perimeter of the evaporator section 4 without blocking the grille 18.

Condensate forms in the evaporator section 4 and may form on the outer surfaces of the evaporator section 4 and portions of the mounting sleeve 14 in contact with the evaporator section 4. Moisture barriers are positioned to prevent condensate from entering the mechanical section 6. A moisture barrier 54 can be positioned between the evaporator section 4 and the mechanical section 6. Additionally, or alternatively, a moisture barrier can be positioned on the inside bottom surface of the evaporator section 4. Another moisture barrier 54 can also be positioned between the mechanical section 6 and the condenser section 8. A moisture barrier trim 55 can also be positioned around a perimeter of the back side facing grille 16 without blocking the grille. The moisture barriers 54 and moisture barrier trim 55 can be made of any type of moisture resistance material, such as a spray, film, or separate panel of material applied to the surfaces of the evaporator section 4 and/or the mechanical section 6.

Figure 8:
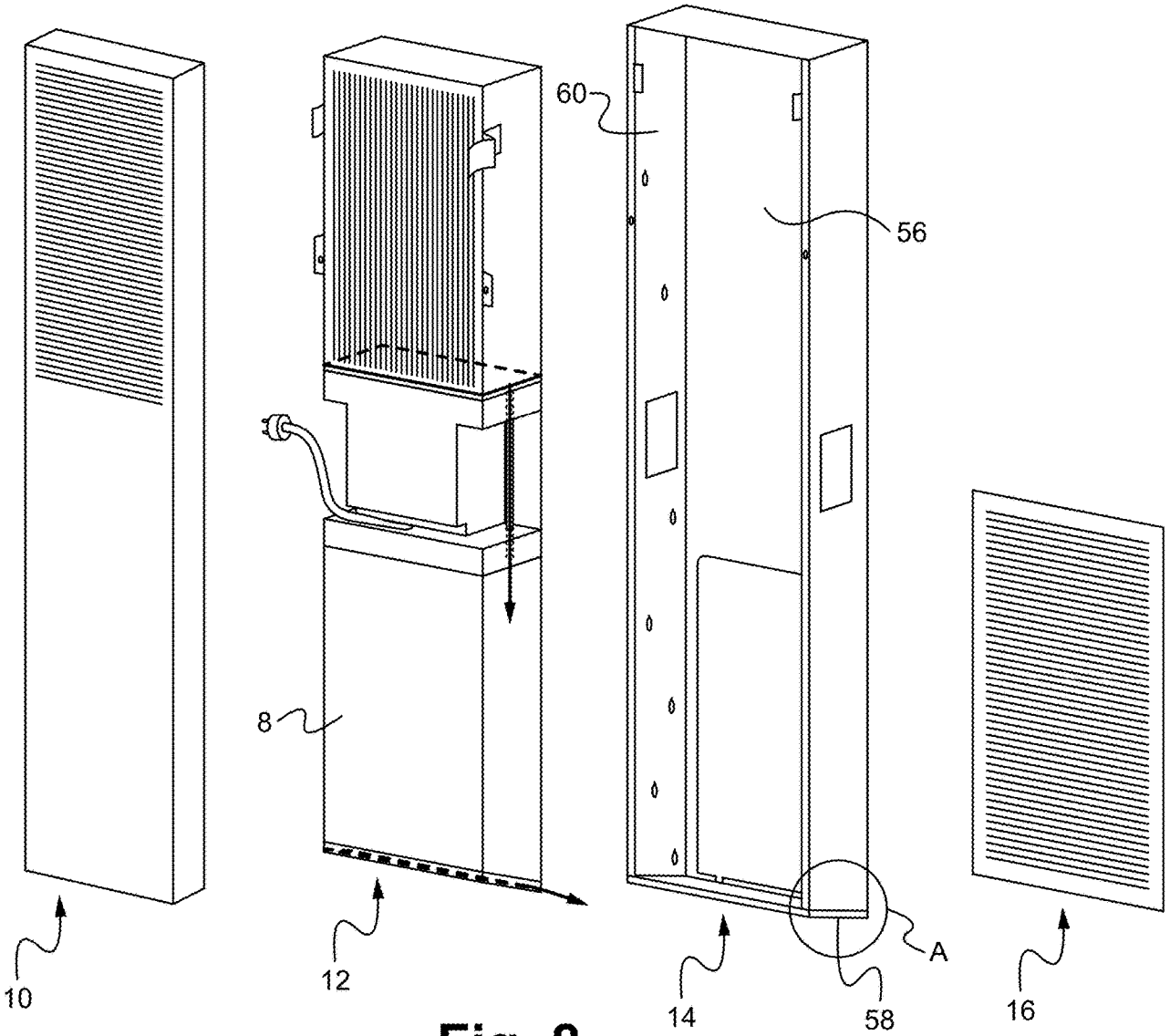
FIG. 8 illustrates an exploded view of the HVAC system including condensate flow according to some embodiments.
Figure 9:
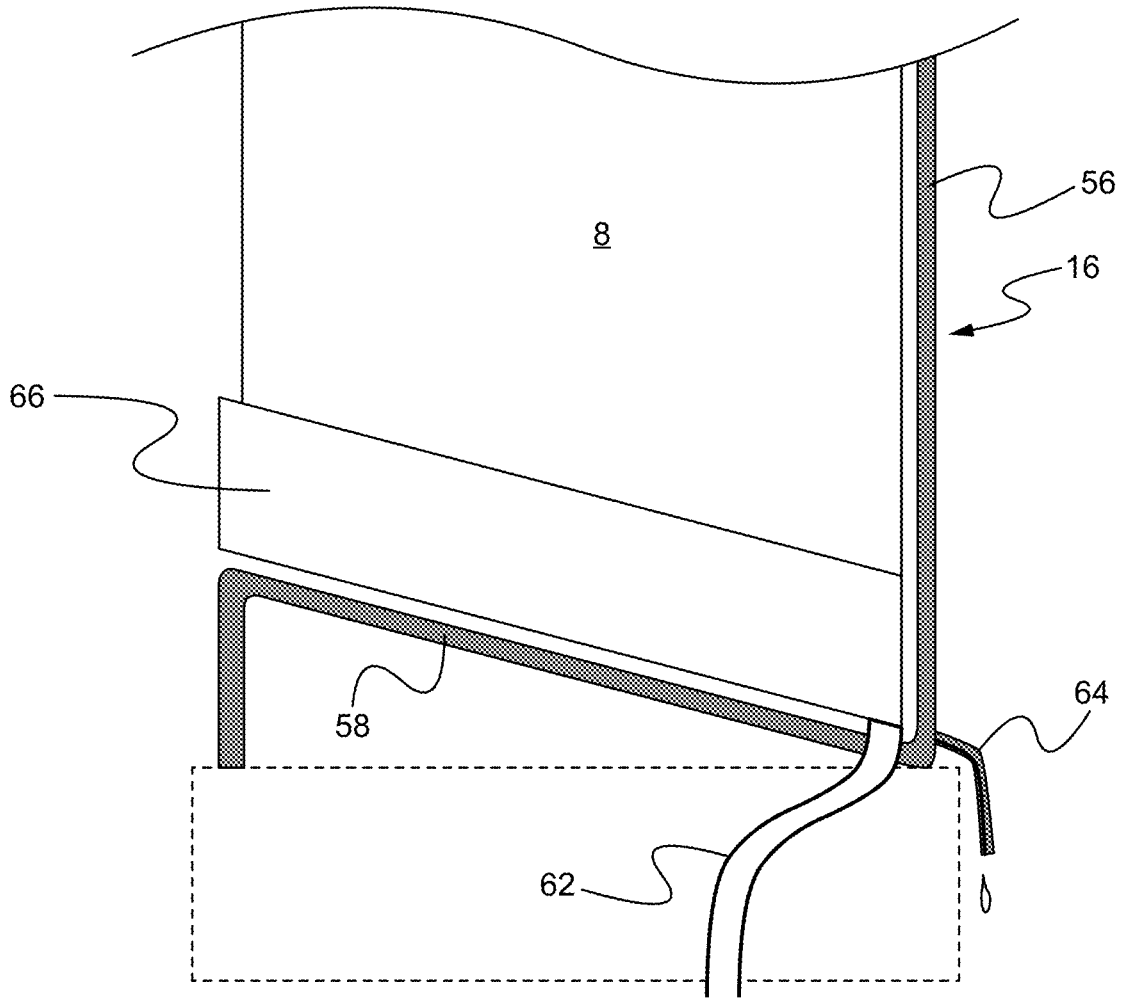
FIG. 9 illustrates a cut out side view of the portion A in FIG. 8 with the HVAC unit mounted in the mounting sleeve according to some embodiments.

Additionally, or alternatively, the HVAC system 2 can be configured to collect and displace condensate. FIG. 8 illustrates an exploded view of the HVAC system 2 including condensate flow according to some embodiments. The evaporator section 4 and the mounting sleeve 14 are configured such that condensate can collect on the interior side surfaces of the mounting sleeve 14 and flow down the interior side surfaces to an interior bottom surface of the mounting sleeve, as shown by the arrows in FIG. 8. In those configurations where the interior back surface of the mounting sleeve 14 does not include thermal or acoustic isolation materials, such as in FIG. 7, condensate can also collect on the interior back surface of the mounting sleeve 14 and flow down the interior back surface to the interior bottom surface of the mounting sleeve. In some embodiments, the bottom surface of the mounting sleeve 14 is sloped, such as shown in FIG. 9, to collect condensate at a bottom most portion. FIG. 9 illustrates a cut out side view of the portion A in FIG. 8 with the HVAC unit 12 mounted in the mounting sleeve 14 according to some embodiments. In this exemplary configuration, a bottom surface (base) of the condenser section 8 is also sloped to match the slope of the mounting sleeve 14. This sloped base enables simple alignment with the mounting sleeve during installation and removes the need to adjust the angle of the HVAC unit 12 for condensate drainage. A drain tube 62 can be attached at the bottom surface of the mounting sleeve 14 to drain out the collected condensate. The drain tube 62 can be directed through a floorboard, such as shown in FIG. 9. Additionally, or alternatively, a drain tube 64 can extend through the back side facing grille 16 to drain out the collected condensate. In some embodiments, a condensate collection tray 66 with one or more drain holes can be positioned at the bottom of the mounting sleeve 14, and the drain tubes 62 and/or 64 can be connected to the condensate collection tray 66.

Condensate within the evaporator section 4 drains to a bottom surface of the evaporator section 4. One or more drain holes or drain tubes can be positioned at the bottom surface of the evaporator section 4 to enable condensate to drain out of the evaporator section 4. In some embodiments, the condensate drains out of the evaporator section 4 and down the interior side surface of the mounting sleeve 14. In some embodiments, condensate output from the evaporator section 4 is directed via drain tubes to the bottom surface of the mounting sleeve 14. In other embodiments, the condensate is enabled to drain across the condenser coil in the condenser section 8 via gravity.

Figure 10:
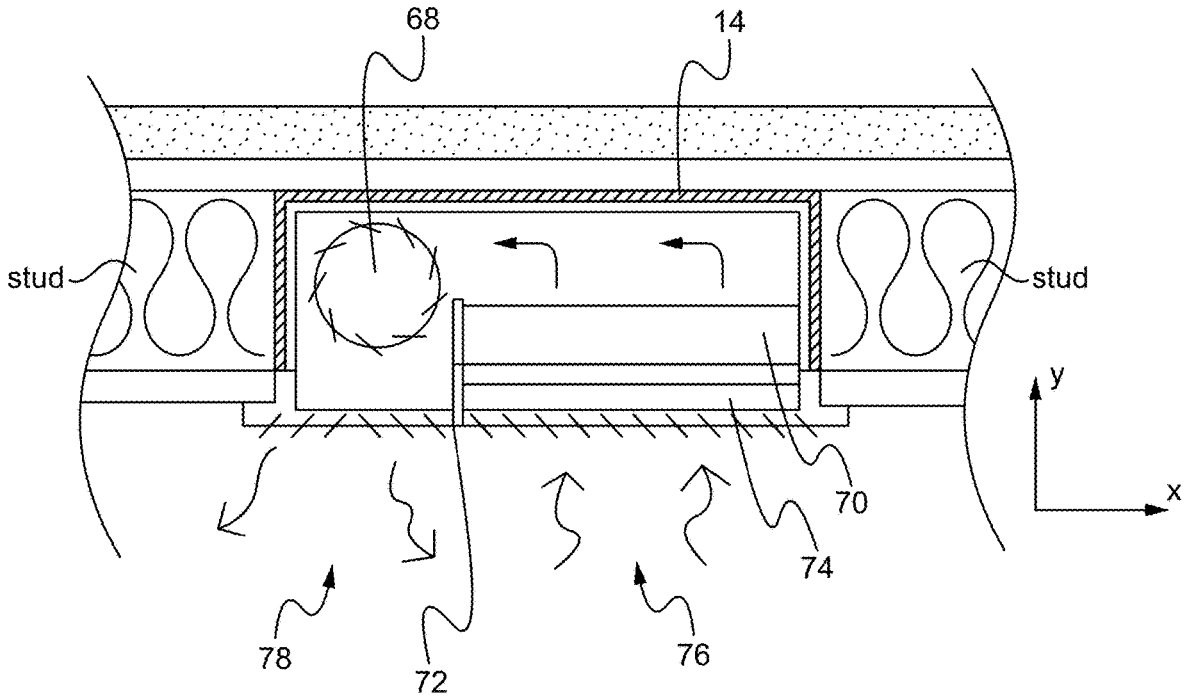
FIG. 10 illustrates a cut-out top down view of an evaporator section installed in a preexisting framework and having a lateral configuration according to some embodiments.

The physical positioning, relative alignment, and dimensions of each of the individual components in each of the evaporator section 4 and the condenser section 8 can vary according to numerous different configurations and applications. In some embodiments, the air mover is positioned to a lateral side of the heat exchanger, i.e. horizontal to the heat exchanger, in either or both of the evaporator section 4 and the condenser section 8. FIG. 10 illustrates a cut-out top down view of an evaporator section installed in a preexisting framework and having a lateral configuration according to some embodiments. The mounting sleeve 14 is mounted to the side walls (studs) and the back wall of the preexisting framework. In the lateral configuration, an air mover 68 is positioned laterally adjacent to a heat exchanger 70. In some embodiments, the air mover 68 includes a tangential fan. It is understood that other types of fans can be used. Input air 76 from the interior of the dwelling is drawn into the evaporator section 4 by the air mover 68 through a first side of a front side grille 72. The input air 76 passes through a filter 74 and across the heat exchanger 70, such as an evaporator coil, and is directed via an air plenum back out the evaporator section 4 through a second side of the front side grille 72 as output air 78. In the exemplary configuration shown in FIG. 10, the first side of the front side grille 72 is the right hand side through which the input air 76 enters, and the second side of the front side grille 72 is the left hand side through which the output air 78 exits. It is understood that these sides can be reversed. The air mover 68, the heat exchanger 70, and the front side grille 72 are analogous to the previously described air mover, the heat exchanger, and the front side grille of the evaporator section. In some embodiments, turning vanes can be positioned adjacently behind the heat exchanger 70 within the evaporator section 4 to redirect airflow toward the air mover 68, which reduces air pressure drop, and improves or smooths airflow across the heat exchanger. The front side grille 72 can also include curved blades which reduces noise and airflow pressure drop.

Figure 11:
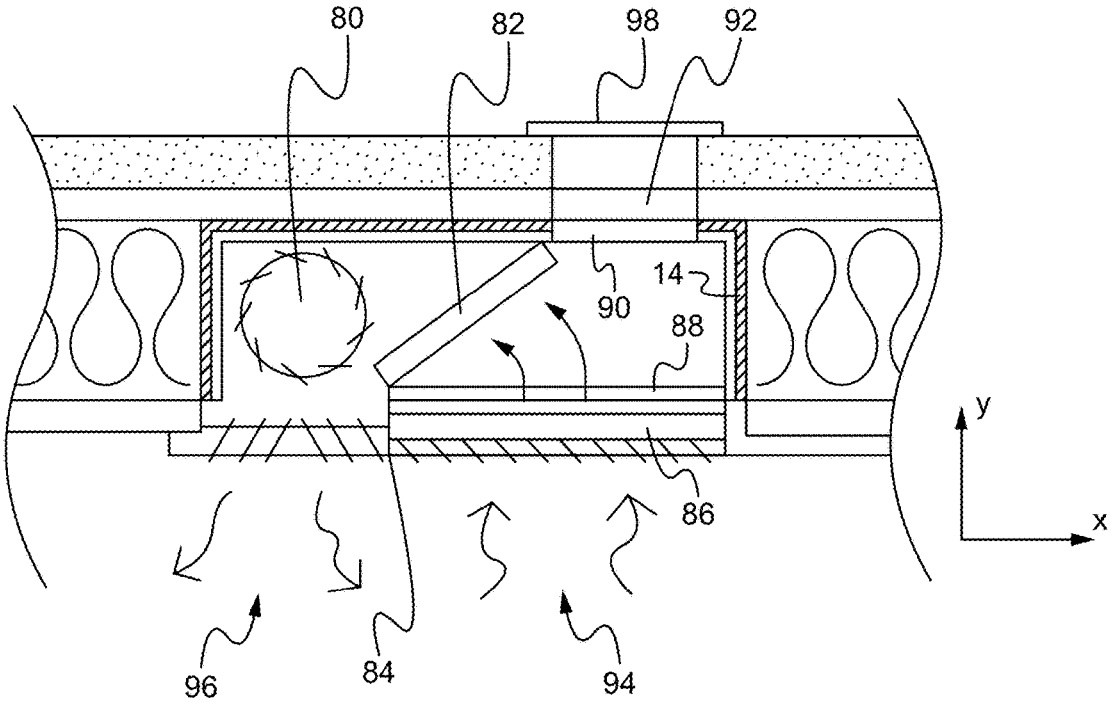
FIG. 11 illustrates a cut-out top down view of an evaporator section installed in a preexisting framework and having a lateral configuration and outdoor ventilation according to some embodiments.

In the above described configurations, the evaporator section has indoor ventilation, via the front side opening in the mounting sleeve and the front side grille, but no outdoor ventilation. In other embodiments, the evaporator section, mounting sleeve, and dwelling wall can be configured to include outdoor ventilation. FIG. 11 illustrates a cut-out top down view of an evaporator section installed in a preexisting framework and having a lateral configuration and outdoor ventilation according to some embodiments. The mounting sleeve 14 is mounted to the side walls (studs) and the back wall of the preexisting framework. In the lateral configuration, an air mover 80 is positioned laterally adjacent to a heat exchanger 82. In some embodiments, the air mover 80 includes a tangential fan. It is understood that other types of fans can be used. Input air 94 from the interior of the dwelling is drawn into the evaporator section 4 by the air mover 80 through a first side of a front side grille 84. The input air 94 passes through an air filter 86 and across the heat exchanger 82, such as an evaporator coil, and is directed via an air plenum back out the evaporator section 4 through a second side of the front side grille 84 as output air 96. In the exemplary configuration shown in FIG. 11, the first side of the front side grille 84 is the right hand side through which the input air 94 enters, and the second side of the front side grille 84 is the left hand side through which the output air 96 exits. It is understood that these sides can be reversed. The air mover 80, the heat exchanger 82, and the front side grille 84 are analogous to the previously described air mover, the heat exchanger, and the front side grille of the evaporator section. Outdoor ventilation 98 is provided at the back side of the evaporator section 4 via a back side opening in the mounting sleeve 14 and the back wall of the dwelling. The opening is covered on the exterior of the dwelling by a grille (not shown). A balancing damper 92 and an air filter 90 are positioned at the back side opening, and a balancing damper 88 is positioned proximate the air filter 86. The balancing damper 98 can be an automated balancing damper under the control of the HVAC unit controller 34 (FIG. 2). Baffles in the balancing dampers 88, 92 enable mixing of the input air 94 with ambient air from the exterior, which enables control of the air temperature of the air passing across the heat exchanger 82. In some embodiments, the air temperature is controlled to be greater than a threshold temperature. The front side grille 84 can include curved blades which reduces noise and airflow pressure drop. In some embodiments, such as that shown in FIG. 11, the heat exchanger 82 is angled relative to horizontal. The angled orientation increases surface area relative to a horizontally oriented heat exchanger, such as the heat exchanger 70 shown in FIG. 10. It is understood that the angled heat exchanger also can be applied in the lateral configuration shown in FIG. 10, and that the horizontally oriented heat exchanger shown in FIG. 10 can be used in the lateral configuration shown in FIG. 11.

Alternatively to a lateral configuration, a stacked configuration can be used where the air mover is positioned above or below the heat exchanger, i.e. vertical to the heat exchanger, in either or both of the evaporator section 4 and the condenser section 8. An example of such a stacked configuration is described in the U.S. Patent Application Ser. No. 62/788,350, entitled "HVAC System with Coil Arrangement in Blower Unit", which is hereby incorporated in its entirety by reference.

Similar lateral or stacked configurations can be used for the condenser section 8, except instead of the input air being input from and output to an interior of the dwelling, air is input from and output to an exterior of the dwelling via a back side grille, such as the back side grille 16. It is understood that such a condenser section can also be configured with interior ventilation to enable mixing of air, such as used in the configuration shown in FIG. 11.

The present application has been described in terms of specific embodiments incorporating details to facilitate the understanding of the principles of construction and operation of the HVAC system. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A heating, ventilation, and air condition (HVAC) system, comprising:

an HVAC unit comprising an evaporator section having a first heat exchanger, a mechanical section having an HVAC unit controller, and a condenser section having a second heat exchanger, wherein the evaporator section, the mechanical section, and the condenser section are integrated as a single unit; and a mounting sleeve configured to fit within a preexisting framework of a dwelling, wherein in a top-cross section, the first heat exchanger is angled relative to horizontal, thereby increasing an exposed surface area of the first heat exchanger to air drawn through the evaporator section, wherein the HVAC unit controller is configured to control mixing of input air from the dwelling and ambient air from an external of the dwelling, and wherein the mounting sleeve comprises a front side grille having a first side for drawing air into the evaporator section and a laterally adjacent second side for expelling air from the evaporator section.

2. The HVAC system of claim 1, wherein the HVAC unit further comprises interconnecting refrigerant tubing coupled to the evaporator section, the mechanical section, and the condenser section.

3. The HVAC system of claim 1, wherein the HVAC unit further comprises first mounting features, and wherein the mounting sleeve comprises second mounting features for mounting to the first mounting features.

4. The HVAC system of claim 1, wherein the first heat exchanger of the evaporator section comprises an evaporator coil, and wherein the evaporator section further comprises a motorized air mover configured to move air across the evaporator coil.

5. The HVAC system of claim 1, wherein the mechanical section comprises a compressor and an HVAC metering device.

6. The HVAC system of claim 1, further comprising a front side access panel coupled to a front side of the HVAC unit.

7. The HVAC system of claim 6, wherein the front side access panel comprises a front side grille aligned with the evaporator section.

8. The HVAC system of claim 1, further comprising a back side grille coupled to a back side of the HVAC unit.

9. The HVAC system of claim 8, wherein the mounting sleeve includes a back side opening in a back side wall, wherein the back side opening is aligned with the condenser section of the HVAC unit and an exterior opening of the dwelling, and wherein the back side grille is positioned over the back side opening.

10. The HVAC system of claim 1, wherein the second heat exchanger of the condenser section comprises a condenser coil, and wherein the condenser section further comprises a motorized air mover configured to move air across the condenser coil.

11. The HVAC system of claim 10, wherein the condenser section further comprises an accumulator coupled to the condenser coil.

12. The HVAC system of claim 1, wherein the mounting sleeve comprises a back side wall, side walls, a top wall, and a bottom wall, wherein the back side wall is mounted to a framing back side wall of the preexisting framework, and wherein each of the side walls is mounted to a stud of the preexisting framework.

13. The HVAC system of claim 12, wherein one or more of the side walls of the mounting sleeve includes an electrical outlet opening.

14. The HVAC system of claim 13, wherein the mechanical section comprises an electrical power cord, and wherein a first end of the electrical power cord is configured to fit through the electrical outlet opening.

15. The HVAC system of claim 1, wherein the mounting sleeve comprises a bottom side wall that is sloped downwards from a front side of the HVAC unit to a back side of the HVAC unit.

16. The HVAC system of claim 15, wherein the bottom side wall comprises one or more drainage openings.

17. The HVAC system of claim 15, wherein the mounting sleeve further comprises a back side wall having one or more drainage openings proximate the bottom side wall.

18. A heating, ventilation, and air condition (HVAC) system, comprising:

an HVAC unit comprising an evaporator section having a first heat exchanger and a motorized air moving assembly, a mechanical section having an HVAC unit controller, and a condenser section having a second heat exchanger, wherein the evaporator section, the mechanical section, and the condenser section are integrated as a single unit; and a mounting sleeve configured to fit within a preexisting framework of a dwelling, wherein in a top-cross section, the evaporator section includes an area containing the motorized air moving assembly and the first heat exchanger, such that air is drawn through the evaporator section, laterally across the area, wherein the HVAC unit controller is configured to control mixing of input air from the dwelling and ambient air from an external of the dwelling, and wherein the mounting sleeve comprises a front side grille having a first side for drawing air into the evaporator section and a laterally adjacent second side for expelling air from the evaporator section.

19. The HVAC system of claim 18, wherein the motorized air moving assembly is laterally adjacent to the first heat exchanger.

20. The HVAC system of claim 18, wherein the front side grille comprises curved blades.

21. The HVAC system of claim 18, further comprising tuning vanes positioned between the first heat exchanger and the motorized air moving assembly.

* * * * *